US010309410B2

(12) United States Patent
Ottow et al.

(10) Patent No.: US 10,309,410 B2
(45) Date of Patent: Jun. 4, 2019

(54) IMPELLER SHROUD WITH DEFLECTING OUTER MEMBER FOR CLEARANCE CONTROL IN A CENTRIFUGAL COMPRESSOR

(71) Applicant: Rolls-Royce Corporation, Indianapolis, IN (US)

(72) Inventors: Nathan Ottow, Indianapolis, IN (US); Jonathan Acker, Westfield, IN (US); Nate Cooper, Avon, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 492 days.

(21) Appl. No.: 15/165,555

(22) Filed: May 26, 2016

(65) Prior Publication Data

US 2017/0343002 A1 Nov. 30, 2017

(51) Int. Cl.

| | |
|---|---|
| ***F01D 11/22*** | (2006.01) |
| ***F04D 29/16*** | (2006.01) |
| ***F04D 29/28*** | (2006.01) |
| ***F04D 29/42*** | (2006.01) |
| ***F04D 27/00*** | (2006.01) |
| ***F04D 27/02*** | (2006.01) |
| *F01D 11/08* | (2006.01) |
| *F04D 29/62* | (2006.01) |

(52) U.S. Cl.

CPC ..... *F04D 29/162* (2013.01); *F04D 27/002* (2013.01); *F04D 27/0246* (2013.01); *F04D 29/284* (2013.01); *F04D 29/4206* (2013.01); *F01D 11/08* (2013.01); *F01D 11/22* (2013.01); *F04D 29/622* (2013.01); *F05D 2220/32* (2013.01); *F05D 2240/11* (2013.01); *F05D 2260/50* (2013.01); *F05D 2260/57* (2013.01)

(58) Field of Classification Search

CPC ..... F01D 11/22; F01D 11/24; F01D 11/20; F01D 11/14; F04D 29/162; F04D 29/622; F04D 29/284; F04D 29/4206; F04D 29/68; F04D 29/681; F04D 27/0246

See application file for complete search history.

(56) References Cited

U.S. PATENT DOCUMENTS

| | | | | |
|---|---|---|---|---|
| 3,085,398 A * | 4/1963 | Ingleson | F01D 11/22 415/127 |
| 4,264,271 A | 4/1981 | Libertini | |
| 5,263,816 A * | 11/1993 | Weimer | F01D 11/22 415/131 |
| 6,273,671 B1 * | 8/2001 | Ress, Jr. | F01D 5/043 415/1 |
| 7,824,151 B2 * | 11/2010 | Schwarz | F01D 11/08 415/131 |
| 8,087,880 B2 * | 1/2012 | Karafillis | F01D 11/22 415/1 |

(Continued)

*Primary Examiner* — Justin D Seabe
*Assistant Examiner* — Behnoush Haghighian
(74) *Attorney, Agent, or Firm* — Duane Morris LLP

(57) ABSTRACT

A system for controlling the clearance distance between an impeller blade tip of a centrifugal compressor and a radially inner surface of an impeller shroud in a turbine engine. The system comprises a two-piece integral impeller shroud with a fixed inner member and a variable outer member. An actuator is coupled to an aft end of the variable outer member and imparts axially forward and aft motion on the aft end, causing deflection of the outer member.

21 Claims, 4 Drawing Sheets

(56) References Cited

U.S. PATENT DOCUMENTS

| | | | | |
|---|---|---|---|---|
| 8,105,012 | B2 * | 1/2012 | Anema | F04D 27/0238 415/108 |
| 9,121,302 | B2 * | 9/2015 | Duong | F01D 11/22 |
| 9,587,507 | B2 * | 3/2017 | Ottow | F04D 29/4206 |
| 2008/0134659 | A1 | 6/2008 | Schwarz et al. | |
| 2017/0198709 | A1 * | 7/2017 | Moniz | F04D 29/4206 |
| 2017/0234147 | A1 * | 8/2017 | Moniz | F16J 15/164 415/173.1 |

* cited by examiner

IMPELLER SHROUD WITH DEFLECTING OUTER MEMBER FOR CLEARANCE CONTROL IN A CENTRIFUGAL COMPRESSOR

FIELD OF THE DISCLOSURE

The present invention relates generally to turbine engines having centrifugal compressors and, more specifically, to control of clearances between an impeller and a shroud of a centrifugal compressor.

BACKGROUND

Centrifugal compressors are used in turbine machines such as gas turbine engines to provide high pressure working fluid to a combustor. In some turbine machines, centrifugal compressors are used as the final stage in a multi-stage high-pressure gas generator.

FIG. 1 is a schematic and sectional view of a centrifugal compressor system 100 in a gas turbine engine. One of a plurality of centrifugal compressor blades 112 is illustrated. As blade 112 rotates, it receives working fluid at a first pressure and ejects working fluid at a second pressure which is higher than first pressure. The radially-outward surface of each of the plurality of compressor blades 112 comprises a compressor blade tip 113.

An annular shroud 120 encases the plurality of blades 112 of the impeller. The gap between a radially inner surface 122 of shroud 120 and the impeller blade tips 113 is the blade tip clearance 140 or clearance gap. Shroud 120 may be coupled to a portion of the engine casing 131 directly or via a first mounting flange 133 and second mounting flange 135.

Gas turbine engines having centrifugal compressor systems 100 such as that illustrated in FIG. 1 typically have a blade tip clearance 140 between the blade tips 113 and the shroud 120 set such that a rub between the blade tips 113 and the shroud 120 will not occur at the operating conditions that cause the highest clearance closure. A rub is any impingement of the blade tips 113 on the shroud 120. However, setting the blade tip clearance 140 to avoid blade 112 impingement on the shroud 120 during the highest clearance closure transient may result in a less efficient centrifugal compressor because working fluid is able to flow between the blades 112 and shroud 120 thus bypassing the blades 112. This working fluid constitutes leakage. In the centrifugal compressor system 100 of FIG. 1, blade tip clearances 140 cannot be adjusted because shroud 120 is rigidly mounted to the engine casing 131.

It is known in the art to dynamically change blade tip clearance 140 to reduce leakage of a working fluid around the blade tips 113. Several actuation systems for adjusting blade tip clearance 140 during engine operation have been developed. These systems often include complicated linkages, contribute significant weight, and/or require a significant amount of power to operate. Thus, there continues to be a demand for advancements in blade clearance technology to minimize blade tip clearance 140 while avoiding rubs.

The present application discloses one or more of the features recited in the appended claims and/or the following features which, alone or in any combination, may comprise patentable subject matter.

SUMMARY

According to an aspect of the present disclosure, a compressor shroud assembly in a turbine engine having a dynamically moveable impeller shroud for encasing a rotatable centrifugal compressor and maintaining a clearance gap between the shroud and the rotatable centrifugal compressor, said assembly comprises: a static compressor casing; an actuator mounted to said casing; and a double-walled impeller shroud comprising a pair of nested arcuate shroud members shaped to follow the contour of the rotatable centrifugal compressor, a forward member mounted to said casing and an aft member deflectively coupled to said forward member and operatively coupled to said actuator to effect deflection of said aft member relative to said forward member and to the rotatable centrifugal compressor when said actuator is activated.

In some embodiments said nested members form a chamber adapted to receive actuating air, said aft member being deflected responsive to the provision of actuating air to said chamber. In some embodiments the actuation air is drawn from the discharge air of the rotatable centrifugal compressor. In some embodiments the deflective coupling between said shroud members comprises a bellows coupling at the aft end of said shroud members. In some embodiments said shroud members are statically coupled at a forward end thereof. In some embodiments said actuator comprises a mechanical driver coupled to the aft end of said aft member to effect deflection of said aft member responsive to the provision of a driving force to said member by said mechanical driver. In some embodiments the deflective coupling between said shroud members comprises a bellows coupling at the aft end of said shroud members. In some embodiments said actuator comprises a cylindrical member coupled to said casing wherein the axial motion of said cylindrical member effects axial translation of said aft shroud member. In some embodiments said actuator comprises a pneumatic piston coupled to said casing wherein the actuation of said piston effects axial translation of said aft shroud member. In some embodiments the assembly further comprises one or more sensors for measuring the fluid pressure in said chamber, said chamber being actuated or vented in response to the measured fluid pressure in said chamber. In some embodiments the assembly further comprises one or more sensors for measuring the clearance gap between said shroud and the rotating centrifugal compressor, said chamber being actuated or vented in response to the clearance gap measure by the one or more sensors. In some embodiments the assembly further comprises a chamber bounded in part by said casing and at least a portion of the impeller shroud proximate the aft end thereof, said chamber being pressurized at a pressure between ambient pressure and 450 pounds per square inch.

According to another aspect of the present disclosure, a method of dynamically changing a clearance gap between a rotatable centrifugal compressor and a shroud encasing the rotating centrifugal compressor, said method comprises: mounting a forward shroud member to a static casing; nesting and deflectively coupling an aft shroud member to the forward shroud member forming a double-walled shroud following the contour of the rotatable centrifugal compressor; and deflecting the aft shroud member relative to the forward shroud member and the rotatable centrifugal compressor.

In some embodiments the method further comprises deflecting the aft shroud member by providing actuation air to a chamber formed between the shroud members. In some embodiments the method further comprises providing actuating air from the discharge of the rotatable centrifugal compressor. In some embodiments the method further comprises sensing the air pressure in the chamber and providing actuating air to the chamber in response to the sensed air pressure. In some embodiments the method further comprises sensing the clearance gap between the rotatable centrifugal compressor and the shroud and providing actuating air to the chamber in response to the sensed clearance gap. In some embodiments the method further comprises deflecting the aft shroud member by providing a mechanical force to the aft shroud member from a mechanical driver. In some embodiments the method further comprises sensing the clearance gap and deflecting the aft shroud member responsive to the sensed clearance gap. In some embodiments the clearance gap is sensed by more than one clearance gap sensor positioned along the length of the aft shroud member.

BRIEF DESCRIPTION OF THE DRAWINGS

The following will be apparent from elements of the figures, which are provided for illustrative purposes and are not necessarily to scale.

Figure 1:
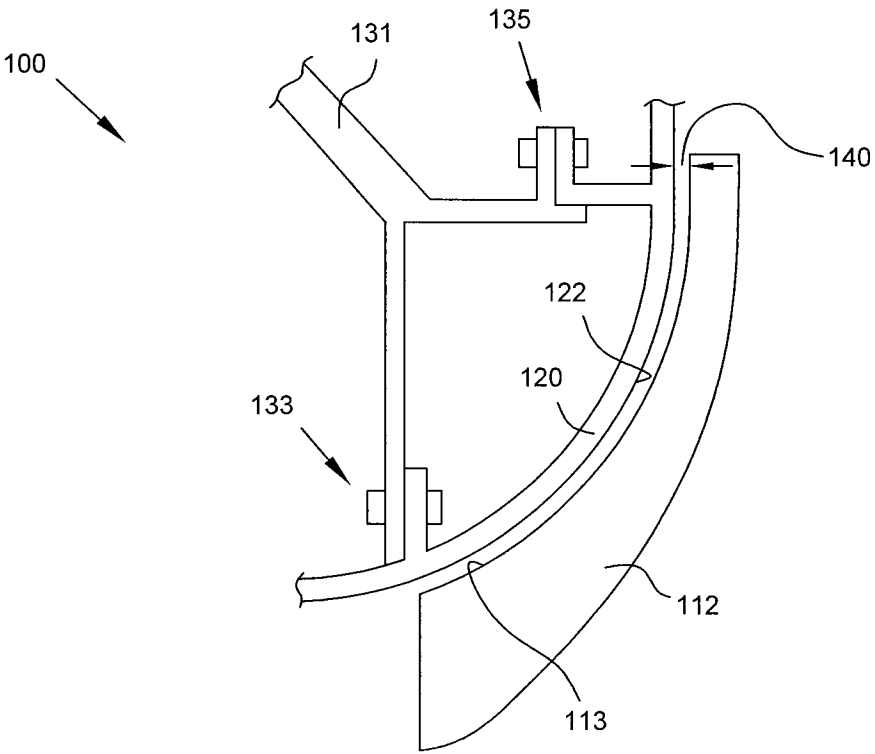
FIG. 1 Prior Art
FIG. 1 is a schematic and sectional view of a centrifugal compressor system in a gas turbine engine.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

This disclosure presents embodiments to overcome the aforementioned deficiencies in clearance control systems and methods. More specifically, the present disclosure is directed to a system for clearance control of blade tip clearance which avoids the complicated linkages, significant weight penalties, and/or significant power requirements of prior art systems. The present disclosure is directed to a system which uses a two piece joined shroud construction to deflect an aft portion of the shroud toward or away from the blade tips.

Figure 2A:
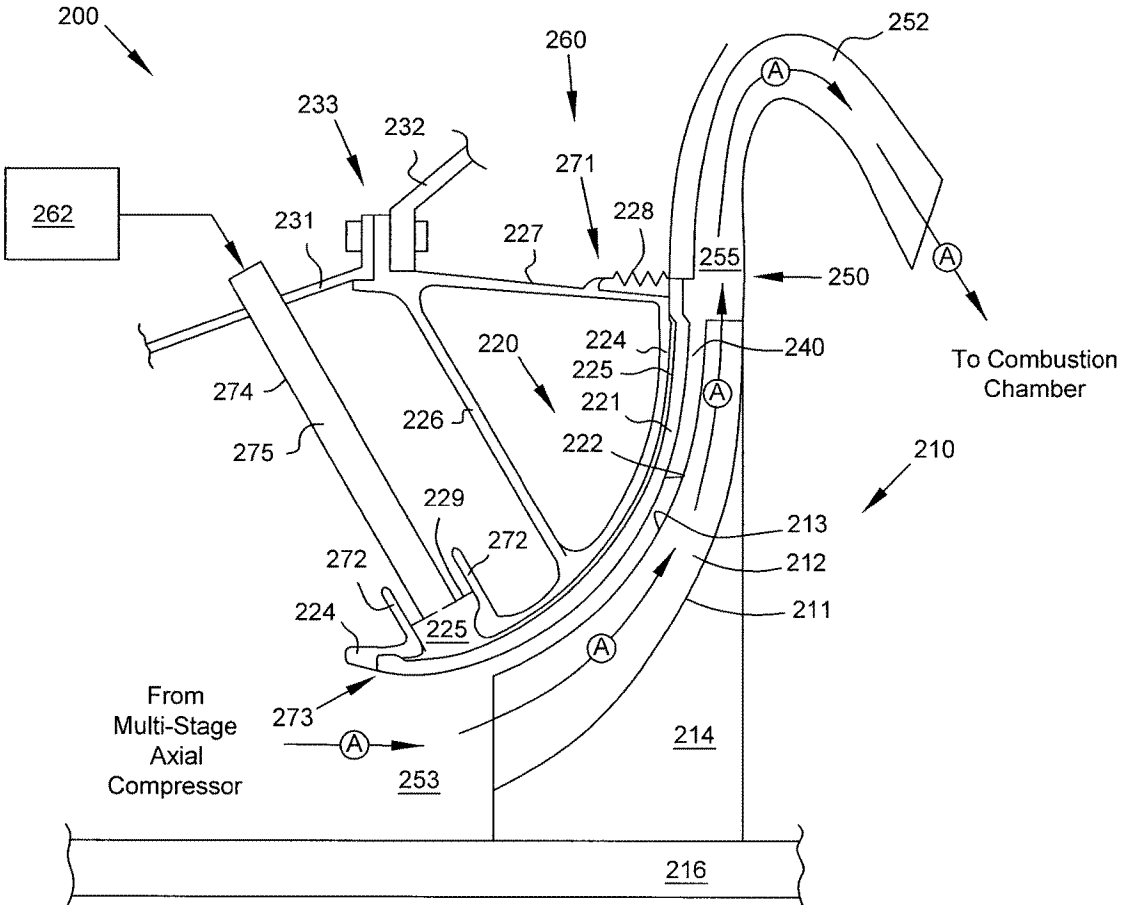
FIG. 2A is a schematic and sectional view of a centrifugal compressor system having a clearance control system in accordance with some embodiments of the present disclosure.

FIG. 2A is a schematic and sectional view of a centrifugal compressor system 200 having a clearance control system 260 in accordance with some embodiments of the present disclosure. Centrifugal compressor system 200 comprises centrifugal compressor 210 and clearance control system 260.

The centrifugal compressor 210 comprises an annular impeller 211 having a plurality of centrifugal compressor blades 212 extending radially from the impeller 211. The impeller 211 is coupled to a disc rotor 214 which is in turn coupled to a shaft 216. Shaft 216 is rotatably supported by at least forward and aft shaft bearings (not shown) and may rotate at high speeds. The radially-outward surface of each of the compressor blades 212 constitutes a compressor blade tip 213.

As blade 212 rotates, it receives working fluid at an inlet pressure and ejects working fluid at a discharge pressure which is higher than the inlet pressure. Working fluid (e.g. air in a gas turbine engine) is typically discharged from a multi-stage axial compressor (not shown) prior to entering the centrifugal compressor 210. Arrows A illustrate the flow of working fluid through the centrifugal compressor 210. Working fluid enters the centrifugal compressor 210 from an axially forward position 253 at an inlet pressure. Working fluid exits the centrifugal compressor 210 at an axially aft and radially outward position 255 at a discharge pressure which is higher than inlet pressure.

Working fluid exiting the centrifugal compressor 210 passes through a diffusing region 250 and then through a deswirl cascade 252 prior to entering a combustion chamber (not shown). In the combustion chamber, the high pressure working fluid is mixed with fuel and ignited, creating combustion gases that flow through a turbine (not shown) for work extraction.

In one embodiment, the clearance control system 260 comprises a high pressure air source 262 and an annular shroud 220. Clearance control system 260 may also be referred to as a compressor shroud assembly.

Annular shroud 220 comprises an aft member 221 and an forward member 224. Aft member 221 has a surface 222 opposing impeller blade tips 213. Aft member 221 and forward member 224 are statically coupled at a forward end 273. Aft member 221 and forward member 224 are variably coupled at a aft end 271 by bellows 228. Bellows 228 forms a deflective coupling between aft member 221 and forward member 224. A chamber 225 is defined between aft member 221 and forward member 224. Aft member 221, forward member 224, and chamber 225 are annular and follow the contour of the centrifugal compressor 210. In some embodiments a sensor may be disposed in or in fluid communication with chamber 225 and adapted to measure a fluid pressure or fluid temperature of chamber 225.

Shroud 220 is a dynamically moveable impeller shroud. Shroud 220 may be referred to as a double-wall shroud. Both aft member 221 and forward member 224 follow the contour of an impeller blade 212. Shroud 220 is therefore a double-walled impeller shroud comprising a pair of nested arcuate shroud members 221, 224 which follow the contour of the centrifugal compressor 210. Aft member 221 is deflectively coupled to forward member 224. Aft member 221 deflects relative to forward member 224 and blade tips 213.

Shroud 220 is coupled to at least a portion of the engine casing. In the illustrated embodiment, shroud 220 is coupled to a first casing portion 231 and second casing portion 232 at mount flange 233. In some embodiments first casing portion 231 and second casing portion 232 are at least a portion of a casing around the multi-stage axial compressor. Shroud is coupled via radial arm 226 and axial arm 227. In some embodiments, as illustrated in FIG. 2A, radial arm 226, axial arm 227, and forward member 224 are formed as a unitary component. In other embodiments, radial arm 226, axial arm 227, and forward member 224 are formed separately and joined.

A receiving member 272 extends radially outward from forward member 224 and receives a feed tube 274. A sealing member 229 provides a seal between receiving member 272 and feed tube 274. An interior 275 of feed tube 274 is in fluid communication with chamber 225. In some embodiments a plurality of feed tubes 274 are circumferentially disposed about shroud 220 and fluidly communicate with the annular chamber 225 in a plurality of locations. In some embodiments annular chamber 225 is segregated into a plurality of cavities and each of these cavities is supplied by a one of a plurality of feed tubes 274.

In some embodiments feed tube 274 includes a regulating valve which regulates movement of high pressure air into and out of chamber 225. In some embodiments feed tube 274 further includes a member for venting chamber 225 to atmospheric pressure or to a pressure which is lower than that of chamber 225.

High pressure air source 262 provides high pressure air to chamber 225 via feed tube 274. In some embodiments high pressure air source 262 is supplied from centrifugal compressor discharge air.

In some embodiments high pressure air source 262 and bellows 228 comprise an actuator for actuating the deflection of aft shroud 221 from forward shroud 224.

Shroud 220 encases the plurality of blades 212 of the centrifugal compressor 210. In some embodiments, surface 222 of shroud 220 comprises an abradable surface. In some embodiments, a replaceable cover is provided which covers the surface 222 and is replaced during engine maintenance due to impingement of blade tips 213 against surface 222.

The gap between a surface 222 of shroud 220 which faces the impeller 211 and the impeller blade tips 213 is the blade tip clearance 240. In operation, thermal, mechanical, and pressure forces act on the various components of the centrifugal compressor system 200 causing variation in the blade tip clearance 240. For most operating conditions, the blade tip clearance 240 is larger than desirable for the most efficient operation of the centrifugal compressor 210. These relatively large clearances 240 avoid rubbing between blade 212 and the surface 222 of shroud 220, but also result in high leakage rates of working fluid past the impeller 211. It is therefore desirable to control the blade tip clearance 240 over a wide range of steady state and transient operating conditions. The disclosed clearance control system 260 provides blade tip clearance 240 control by positioning shroud 220 relative to blade tips 213.

Figure 2B:
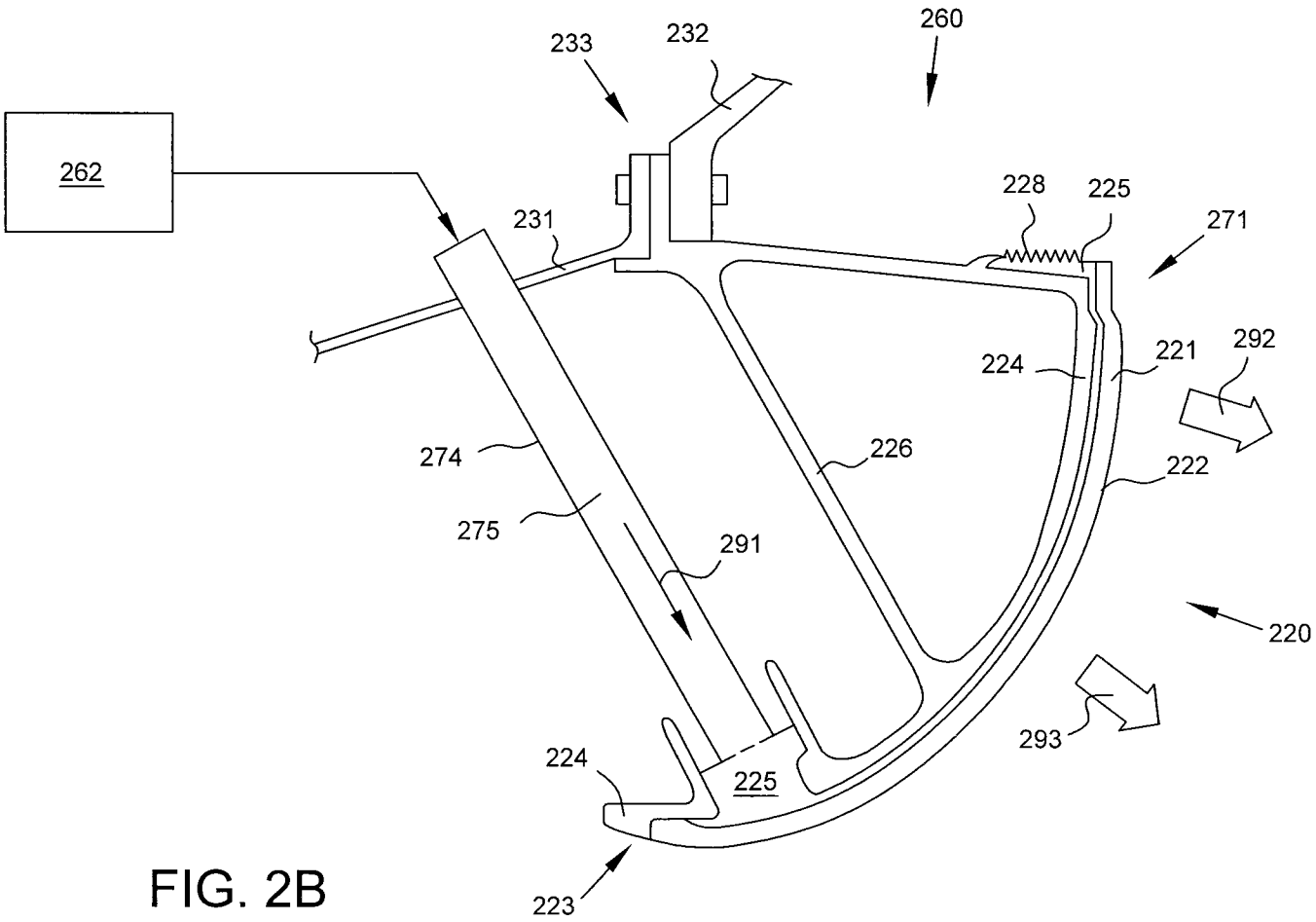
FIG. 2B is an enlarged schematic and sectional view of the clearance control system illustrated in FIG. 2A, in accordance with some embodiments of the present disclosure.

FIG. 2B is an enlarged schematic and sectional view of the clearance control system 260 illustrated in FIG. 2A, in accordance with some embodiments of the present disclosure. The operation of clearance control system 260 will be discussed with reference to FIG. 2B.

In some embodiments during operation of centrifugal compressor 210 blade tip clearance 240 is monitored by periodic or continuous measurement of the distance between surface 222 and blade tips 213 using a sensor or sensors positioned at selected points along the length of surface 222. When clearance 240 is larger than a predetermined threshold, it may be desirable to reduce the clearance 240 to prevent leakage and thus improve centrifugal compressor efficiency.

In other embodiments, engine testing may be performed to determine blade tip clearance 240 for various operating parameters and a piston chamber 274 pressure schedule is developed for different modes of operation. For example, based on clearance 240 testing, piston chamber 274 pressures may be predetermined for cold engine start-up, warm engine start-up, steady state operation, and max power operation conditions. As another example, a table may be created based on blade tip clearance 240 testing, and piston chamber 274 pressure is adjusted according to operating temperatures and pressures of the centrifugal compressor 210. Thus, based on monitoring the operating conditions of the centrifugal compressor 210 such as inlet pressure, discharge pressure, and/or working fluid temperature, a desired blade tip clearance 240 is achieved according to a predetermined schedule of pressures for piston chamber 274.

Regardless of whether clearance 240 is actively monitored or controlled via a schedule, in some operating conditions it may be desirable to reduce the clearance 240 in order to reduce leakage past the centrifugal compressor 210. In order to reduce the clearance 240, high pressure gas is supplied by high pressure gas source 262 to chamber 225 via interior 275 of feeder tube 274 as indicated by arrow 291. Chamber 225 expands due to the admission of high pressure gas. With forward member 224 rigidly coupled, or "grounded", to the engine casing, the expansion of chamber 225 is directed toward aft member 221. Bellows 228 expands in an axially aft direction, and aft member 221 deflects in a simultaneously radially inward and axially aft direction as indicated by arrows 292 and 293. The deflective motion of aft member 221 is controlled by the rigid coupling to forward member 224 at the forward end 223 and the variable or flexible coupling to forward member 224 at aft end 271.

The axially aft deflection of aft member 221 results in the surface 222 moving closer to blade tips 213, thus reducing the clearance 240 and leakage. During many operating conditions this deflection of aft member 221 in the direction of blade tips 213 is desirable to reduce leakage and increase compressor efficiency.

Where monitoring of blade tip clearance 240 indicates the need for an increase in the clearance 240, high pressure air is bled from chamber 225. As chamber 225 contracts, aft member 221 moves in a simultaneously radially outward and axially forward direction. Thus, by bleeding air from chamber 225, surface 222 is moved axially forward, away from blade tips 213 and increasing blade tip clearance 240.

Figure 3:
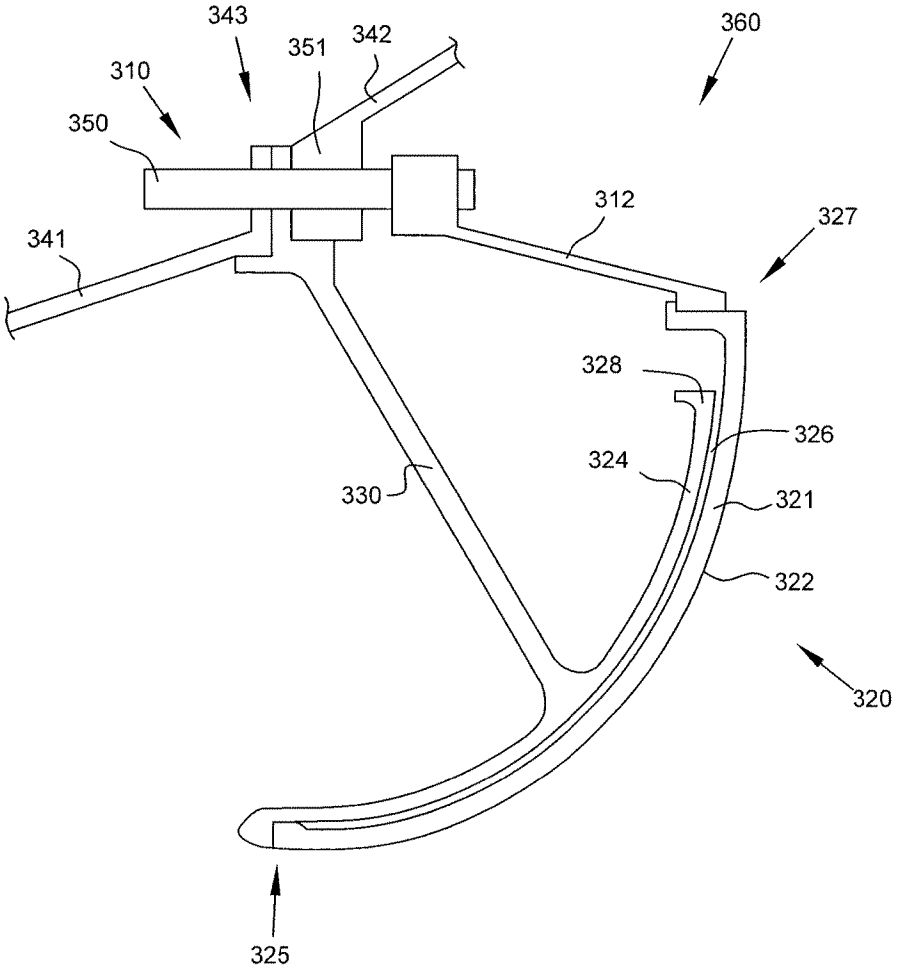
FIG. 3 is a schematic and sectional view of a clearance control system in accordance with some embodiments of the present disclosure.

FIG. 3 is a schematic and sectional view of another embodiment of a clearance control system 360 in accordance with the present disclosure. Clearance control system 360 comprises an annular shroud 320, an mechanical driver 310, and a driving arm 312 coupled between the annular shroud 320 and mechanical driver 310. In some embodiments mechanical driver 310 may be an actuator.

Shroud 320 comprises an inner member 321 and outer member 324. Inner member 321 has a surface 322 which faces the impeller blades 212 of centrifugal compressor 210. Both inner member 321 and outer member 324 follow the contour of an impeller blade 212. Inner member 321 and outer member 324 are coupled at a forward end 325 of shroud 320. A gap 326 is defined between inner member 321 and outer member 324. Inner member 321 is coupled to driving an 213 at an aft end 327. Outer member 324 is shorter than inner member 321 and has a free end 328.

Outer member 324 is coupled to casing arm 330. In some embodiments, outer member 324 and casing arm 330 are formed as a unitary structure, while in other embodiments outer member 324 and casing arm 330 are formed separately and joined. Casing arm 330 is coupled to a first casing portion 341 and a second casing portion 342 at mounting flange 343. Thus casing arm 330 anchors or "grounds" the shroud 320 to at least a portion of the engine casing. In some embodiments, one or both of first casing portion 341 and second casing portion 342 are portions of a compressor casing.

In some embodiments, mechanical driver 310 passes through or is coupled to mounting flange 343. Mechanical driver 310 in the illustrated embodiment comprises a cylindrical member 350 adapted to be received by an orifice portion 351 of second casing portion 342. In some embodiments seals (not shown) may be provided between cylindrical member 350 and orifice portion 351. Cylindrical member 350 is adapted to be axially driven by a motive force provider (not shown). Cylindrical member 350 imparts axial movement on driving arm 312, which in turn imparts axial movement on the aft end 327 of inner member 321 of shroud 320.

In some embodiments cylindrical member 350 may be threadably disposed in orifice portion 351, and motive force provider may be adapted to provide rotating motion to threaded cylindrical member 350. The rotational movement of cylindrical member 350 may be translated into axial movement. Cylindrical member 350 imparts axial movement on driving arm 312, which in turn imparts axial movement on the aft end 327 of inner member 321 of shroud 320.

Movement in the axially aft direction of driving arm 312 causes deflection of inner member 321. The deflective motion of aft member 221 is controlled by the rigid coupling to outer member 324 at the forward end 325 and the variable or flexible coupling to driving arm 312 at aft end 327. The axially aft deflection of inner member 321 results in the surface 322 moving closer to blade tips 213, thus reducing the clearance 240 and leakage. During many operating conditions this deflection of aft member 221 in the direction of blade tips 213 is desirable to reduce leakage and increase compressor efficiency.

Where movement away from blade tips 213 is desired in order to provide greater blade tip clearance 240, cylindrical member 350 is rotated in the opposite direction.

In some embodiments, mechanical driver 310 is a pneumatic piston and actuation of the piston effects axial translation of aft member 221.

In some embodiments a sealed, pressurized cavity is formed proximal the forward side of forward member 224. The cavity may be bounded by forward member 224, and portions of casing 231, 232, 226. This cavity may be pressurized using an intermediate stage compressor air, inducer air, or discharge air from the centrifugal compressor 210. By pressurizing the forward side of forward member 224, the differential pressure across shroud 220 is reduced, thus reducing the amount of work required to translate aft member 221 axially forward and aft.

The present disclosure provides many advantages over previous systems and methods of controlling blade tip clearances. The disclosed clearance control systems allow for tightly controlling blade tip clearances, which are a key driver of overall compressor efficiency. Improved compressor efficiency results in lower fuel consumption of the engine. Additionally, the present disclosure eliminates the use of complicated linkages, significant weight penalties, and/or significant power requirements of prior art systems.

Although examples are illustrated and described herein, embodiments are nevertheless not limited to the details shown, since various modifications and structural changes may be made therein by those of ordinary skill within the scope and range of equivalents of the claims.

What is claimed is:

1. A compressor shroud assembly in a turbine engine, said compressor shroud assembly comprising:

a static compressor casing;

an actuator mounted to said casing; and a double-walled impeller shroud for encasing a rotatable centrifugal compressor, the impeller shroud comprising a pair of nested arcuate shroud members shaped to follow the contour of a rotatable centrifugal compressor, said pair of nested arcuate shroud members comprising a forward member mounted to said casing and an aft member deflectively coupled to said forward member and operatively coupled to said actuator to effect deflection of said aft member relative to said forward member and to the rotatable centrifugal compressor when said actuator is activated.

2. The compressor shroud assembly of claim 1 wherein said nested arcuate shroud members form a chamber adapted to receive actuating air, said aft member being deflected responsive to the provision of actuating air to said chamber.

3. The compressor shroud assembly of claim 2 wherein the actuation air is drawn from a discharge air of the rotatable centrifugal compressor.

4. The compressor shroud assembly of claim 2 wherein said aft member of said nested pair of arcuate shroud members is deflectively coupled to said forward member of said nested pair of arcuate shroud members by a bellows, said bellows being coupled between an aft end of said aft member and an aft end of said forward member.

5. The compressor shroud assembly of claim 4 wherein said nested arcuate shroud members are statically coupled at a forward end thereof.

6. The compressor shroud assembly of claim 1 wherein said actuator comprises a mechanical drive member coupled to an aft end of said aft member of said nested pair of arcuate members to effect deflection of said aft member responsive to the provision of a driving force to said aft member by said mechanical drive member.

7. The compressor shroud assembly of claim 6 wherein said aft member is deflectively coupled to said forward member by a bellows, said bellows being coupled between an aft end of said aft member and an aft end of said forward member.

8. The compressor shroud assembly of claim 6 wherein said mechanical drive member comprises a cylindrical member coupled to said casing wherein an axial motion of said cylindrical member effects axial translation of said aft member.

9. The compressor shroud assembly of claim 6 wherein said actuator comprises a pneumatic piston coupled to said casing wherein the actuation of said piston effects axial translation of said aft member.

10. The compressor shroud assembly of claim 2 further comprising one or more sensors for measuring a fluid pressure in said chamber, said chamber being actuated or vented in response to the measured fluid pressure in said chamber.

11. The compressor shroud assembly of claim 2 further comprising one or more sensors for measuring the clearance gap between said shroud and the rotatable centrifugal compressor, said chamber being actuated or vented in response to the clearance gap measured by the one or more sensors.

12. The compressor shroud assembly of claim 1 further comprising a chamber bounded in part by said casing and at least a portion of the impeller shroud proximate an aft end thereof, said chamber being pressurized at a pressure between ambient pressure and 450 pounds per square inch.

13. A method of dynamically changing a clearance gap between a rotatable centrifugal compressor and a double-walled shroud encasing the rotatable centrifugal compressor, said method comprising:

mounting a forward shroud member to a static casing;

nesting and deflectively coupling an aft shroud member to the forward shroud member forming the double-walled shroud to follow the contour of the rotatable centrifugal compressor; and deflecting the aft shroud member relative to the forward shroud member and the rotatable centrifugal compressor.

14. The method of claim 13 wherein deflecting the aft shroud member comprises providing actuation air to a chamber forming between the shroud members.

15. The method of claim 14 further comprising providing actuating air from a discharge of the rotatable centrifugal compressor.

16. The method of claim 14 further comprising sensing air pressure in the chamber, wherein providing the actuating air to the chamber is responsive in response to the sensed air pressure.

17. The method of claim 14 further comprising sensing the clearance gap between the rotatable centrifugal compressor and the shroud, wherein providing actuating air to the chamber is responsive to the sensed clearance gap.

18. The method of claim 13 wherein deflecting the aft shroud member comprises providing a mechanical force to the aft shroud member from a mechanical drive member.

19. The method of claim 18 further comprising:

sensing the clearance gap; and wherein deflecting the aft shroud member is performed responsive to the sensed clearance gap.

20. The method of claim 19 wherein the clearance gap is sensed by a plurality of clearance gap sensors positioned along a length of the aft shroud member.

21. A turbine engine comprising:

a rotatable centrifugal compressor; and a compressor shroud assembly at least partly encasing the rotatable centrifugal compressor, the compressor shroud assembly comprising:

a static compressor casing;

an actuator mounted to said casing; and a double-walled impeller shroud comprising a pair of nested arcuate shroud members shaped to follow the contour of the rotatable centrifugal compressor, the pair of nested arcuate shroud members comprising a forward member mounted to said casing and an aft member deflectively coupled to said forward member and operatively coupled to said actuator to effect deflection of said aft member relative to said forward member and to the rotatable centrifugal compressor when said actuator is activated.

* * * * *